United States Patent [19]

Harrigan, Jr. et al.

[11] 4,223,075

[45] Sep. 16, 1980

[54] GRAPHITE FIBER, METAL MATRIX COMPOSITE

[75] Inventors: William C. Harrigan, Jr., Seal Beach; Robert H. Flowers, Torrance; Silas P. Hudson, Simi Valley, all of Calif.

[73] Assignee: The Aerospace Corporation, El Segundo, Calif.

[21] Appl. No.: 761,188

[22] Filed: Jan. 21, 1977

[51] Int. Cl.[3] ..... B32B 5/14; B32B 7/00

[52] U.S. Cl. ..... 428/610; 428/614; 428/627; 428/634

[58] Field of Search ..... 428/611, 610, 614, 627, 428/634, 941

[56] References Cited

U.S. PATENT DOCUMENTS

| | | | |
|---|---|---|---|
| 3,484,270 | 12/1969 | Pinter | 428/634 |
| 3,622,283 | 11/1971 | Sara | 428/614 |
| 3,720,257 | 3/1973 | Beutler | 428/614 |
| 3,828,417 | 8/1974 | Divecha | 428/611 |
| 3,837,819 | 9/1974 | Hibbs, Jr. | 428/941 |
| 3,840,350 | 10/1974 | Tucker, Jr. | 428/634 |
| 3,860,443 | 1/1975 | Lachman et al. | 428/611 |
| 3,885,959 | 5/1975 | Badia et al. | 428/634 |
| 3,888,661 | 6/1975 | Levitt et al. | 428/634 |

*Primary Examiner*—L. Dewayne Rutledge
*Assistant Examiner*—Michael L. Lewis
*Attorney, Agent, or Firm*—Francis R. Reilly

[57] ABSTRACT

Metals constituting the matrix of carbon (graphite) filament reinforced composites are alloyed with titanium and boron to prevent or reduce the migration of the titanium-boron coating applied to the filaments prior to their impregnation with the metal matrix materials.

4 Claims, No Drawings

GRAPHITE FIBER, METAL MATRIX COMPOSITE

This invention relates to the field of carbon (graphite) filament reinforced metal matrix composites exhibiting high strength characteristics and capability of retaining integrity and strength at temperatures above the critical temperature of the metals in their non-reinforced condition. The qualities of these composites render them excellent candidates for use in weight-critical structures as airframes and space vehicles. Other possible and actual applications of these composites are addressed in the prior art.

The prime difficulty in producing graphite filament reinforced metal composites is the achievement of a strong bond at the interface of the filaments and the metals in which they are embedded. The bond is generally non-existent between nascent graphite filaments and metal matrix materials because in contacting the filaments with the molten metal, a normal or conventional step in forming these composites, the filaments are not wetted by the metal. Upon solidification, the composite is not integrated mass and thus loads applied to the metal are not transferred to and absorbed by the higher strength filaments in the composite. Another undesirable result of contacting nascent graphite filaments with the moltent metal matrix material is the formation of certain unstable metal carbides at the interface of the filaments and metal. The degradation of the metal carbide ultimately results in debonding of the filaments from the metal with accompanying loss of integrity.

One of the most recent developments in the field of the present invention is the process of pre-treating graphite filaments by the vapor deposition of a titanium-boron or titanium boride film on the surfaces of the filaments. This film, deposited to a thickness in the range of 0.01 to 2.0 microns, adheres firmly to graphite surfaces and, in turn, is wetted by molten metals and also adheres thereto upon solidification of the metals. The titanium-boron film serves a secondary but no less important function as a protective coating for the graphite fibers preventing them from attack by the metal matrix material to form a metal carbide.

The above mentioned use of a titanium-boron coating for graphite filaments in metal composites is more fully described in U.S. Pat. No. 3,860,443 of Jan. 14, 1975 to Lachman et al and U.S. Pat. No. 4,082,864 to Kendall et al.

In accordance with the teachings of the above identified patents, the graphite-metal composite is first produced in a continuous wire-like form having a typical diameter of 1–2 mm. The metal is one selected from the group including aluminum, copper, tin, lead, zinc magnesium and alloys thereof. Analysis of the so formed wire shows a content of 28–34% graphite filaments and 72–66% metal with a tensile strength approaching the theoretical as computed on the rule-of-mixtures basis. A chemical analysis of the rod form composite provided by an ion microprobe mass analyzer shows however that the titanium and boron making up the film are absorbed to an extent by, and migrate into, the metal matrix material. This migration occurs by reason of the high temperature and molten condition of the metal matrix when it infiltrates the multi-filament graphite yarn.

In the manufacture of structural components, such as rods and plates, the wire-like metal-graphite filament composite, as initially produced, must be subjected to secondary processing. In such a secondary process, multiple strands of the wire-like composite are laid up in parallel bundles in molds and subjected to reheating to a temperature approaching the liquidus of the metal and under a compacting pressure up to 4000 psi. This action consolidates the wire bundle into an integral mass conforming to the shape provided by the mold. After the secondary hot pressing procedure, it has been found that the resulting structural component has a tensile strength normally in the range of 25–40% lower than the initial tensile strength of the wire-form composite.

The present invention is directed to the achievement of a higher degree of strength in structural components after the secondary fabrication procedure.

It has been found after hot pressing bundles of the wire-form metal-graphite composite that the titanium and boron in the film, as originally deposited on the graphite fibers, has been further absorbed by the metal at the liquidus temperature to which it is raised in such hot compaction and integration process. It is believed that this further absorption of the film constituents weakens its bonding effectiveness between the graphite and metal matrix material. If the composite is repeatedly raised to the liquidus temperature of the metallic component of the composite complete debonding of the metal from the graphite filaments may occur. After debonding the strength of the graphite fibers are no longer imparted to the metal.

We have discovered that the net amount of migration or diffusion of the Ti-B from the film, applied to the graphite fibers, into the metal matrix is reduced substantially by first alloying the metal in the melt with minor portions of titanium and boron when forming the wire-like composite in accordance with the process of the above identified patents to Lachman et al and Kendall et al. The addition of titanium and boron has little or no effect on the physical quality of the wire-like composite as first produced. Examples of the metals which may be so alloyed and formed into metal-graphite fiber composites are aluminum, copper, tin, lead, silver, zinc, magnesium and alloys of these metals. The amount of titanium and boron added to or alloyed with metal matrix may vary moderately but in general these amounts should be approximately 0.25 weight percent titanium and 0.025 weight percent boron. The solubility of titanium and boron is greater in some metals such as copper and the proportions of these alloying metals in copper, for example, may be increased as much as 1.0 and 0.05 weight percent, respectively.

Several examples of the invention as applied to aluminum alloy are as follows:

Two aluminum alloys were reinforced with "Thornel 50" graphite fibers, thereafter fabricated in the forms of rods and plates, and tested. These alloys were aluminum 6061 and 5154. The graphite fibers were coated with Ti and B by the chemical vapor desposition process in accordance with process defined in the above patents. The graphite fibers were in the form of continuous eight strand tows containing 11,000 fibers. These coated fibers were then infiltrated by passing through a molten bath of 6060 Al or 5154 Al and cooled, thereby providing a wire-form of aluminum-graphite composite. All processing was carried out in an inert atmosphere. Specific additions of titanium and boron were then made to each of these alloy baths. In these examples both elements were added to the solubility limits for each element in aluminum alloys at 700° C., i.e., titanium was added to 0.25 weight percent and boron to 0.025 weight percent. Wire-form composites were then made using the modified baths.

Small bars with dimensions of $\frac{1}{4}'' \times \frac{1}{4}''$ were hot pressed using the following consolidation parameters: for 6061 Al composites, 620° C., 400 psi, 15 minutes in vacuum; for 5154 Al composites, 600° C., 600 psi, 15 minutes in vacuum. Plates were fabricated using the following parameters: for both Al and 5154 Al composites, 598° C., 3000 psi, 30 minutes in vacuum. Foils were used in plate manufacture, 6061 Al foils for the 6061 Al composite and 5056 foils for the 5154 composite.

The wires were tensile tested using a "Chinese Torture" gripping technique. Tensile tests were conducted on the bars and samples cut from the plates using thin, 0.020 inch aluminum tabs glued on the grip ends of the tensile specimens.

The tensile tests on the wire demonstrate that the alloy modification does not significantly change the tensile properties of the composite. The results of the tests and other pertinent data are as follows:

TABLE I.

Strength, Modulus and Fiber Data for Wire-Form Composites

| Composite Identification | Tensile Strength (ksi) | Tensile Modulus ($10^6$psi) | Fiber Content (vol. %) |
|---|---|---|---|
| 6061 Al-Graphite | 105 | 22.0 | 30 |
| 6061 Al-Graphite (with added Ti & B) | 105 | 23.0 | 32 |
| 5154 Al-Graphite | 102 | 20.3 | 32 |
| 5154 Al-Graphite (with added Ti & B) | 105 | 22.3 | 33 |

TABLE II.

Strength, Modulus, and Fiber Data for Fabricated Composites

| Composite Identification | Tensile Strength (ksi) | Tensile Modulus ($10^6$psi) | Fiber Content (vol. %) |
|---|---|---|---|
| 6061 Al-Graphite | | | |
| Bar | 80 | 23 | 32 |
| Plate | 64 | 19 | 28 |
| 6061 Al-Graphite (with added Ti & B) | | | |
| Bar | 87 | 24 | 33 |
| Plate | 74 | 24 | 30 |
| 5154 Al-Graphite | | | |
| Bar | 76 | 24.2 | 33 |
| 5154 Al-Graphite (with added Ti & B) | | | |
| Bar | 87 | 25 | 32 |

The foregoing data in the tables shows that the tensile strength of the wire-like composite is substantially the same for the aluminum alloys with or without the addition of Ti and B to the metal matrix. When subsequently fabricated from the unmodified composite, Al 6061-Graphite, in accord with the prior art, rods and plates exhibit respective strength losses of 25% and 39%. With Ti and B added to Al 6061 metal matrix, in accord with the present invention, the strength losses resulting from secondary processing to rod and plate form are reduced to 17% and 30%, respectively.

As is clear from the above examples, the present invention affords a substantial improvement to the prior metal-graphite composites by the mere adjustment of the make-up of the metal by alloying. Thus present apparatus for making the composites in wire-form need not be altered in the adoption of this invention.

Although the invention is herein described by reference to certain specifics in the examples provided, it will be clear that variations may be employed in the practice of the present invention without departing from the spirit and scope thereof as defined in the claims.

We claim:

1. A graphite filament reinforced metal matrix composite comprising:
   (a) at least one multi-strand graphite filament having an initial coating of titanium-boron on the surfaces thereof; and,
   (b) a solid metal matrix having the graphite filament embedded therein and adhered thereto, the metal of said matrix being selected from the group consisting of aluminum, copper, tin lead, silver, zinc, magnesium, and alloys thereof, said metal containing alloying elements of titanium and boron in amounts effective to minimize the net absorption of the initial titanium-boron coating by the metal matrix when said matrix is heated to a temperature approaching the liquidus, or higher.

2. A composite as defined in claim 1, wherein said metal comprises aluminum, or an alloy thereof, and the titanium and boron therein are in the approximate proportions of up to 0.25 and 0.025 weight percent, respectively.

3. A composite as defined in claim 1, wherein said metal comprises tin, or an alloy thereof, and the titanium and boron therein are in the approximate proportions of up to 0.25 and 0.025 weight percent, respectively.

4. A composite as defined in claim 1, wherein said metal comprises copper, and the titanium and boron therein, are in the approximate proportions of up to 1.0 and .05 weight percent, respectively.

* * * * *